United States Patent [19]

Nishida et al.

[11] Patent Number: 4,628,852

[45] Date of Patent: Dec. 16, 1986

[54] OPERATING MEMBER INSTALLATION FOR A SMALL-SIZED MARINE CRAFT

[75] Inventors: Hiroshi Nishida, Miki; Seiichi Ino, Akashi, both of Japan

[73] Assignee: Kawasaki Jukogyo Kabushiki Kaisha, Kobe, Japan

[21] Appl. No.: 686,679

[22] Filed: Dec. 27, 1984

[30] Foreign Application Priority Data

Dec. 28, 1983 [JP] Japan ..... 58-202322[U]

[51] Int. Cl.[4] ..... B63B 35/86

[52] U.S. Cl. ..... 114/270; 440/38; 440/42

[58] Field of Search ..... 114/270; 440/38, 40, 440/41, 42, 43

[56] References Cited

U.S. PATENT DOCUMENTS 3,826,220 7/1974 Jacobson ..... 114/270

FOREIGN PATENT DOCUMENTS 58587 6/1974 Japan .

*Primary Examiner*—Sherman D. Basinger
*Assistant Examiner*—Paul E. Salmon
*Attorney, Agent, or Firm*—Leydig, Voit & Mayer

[57] ABSTRACT

A small-sized marine craft has a floor allowing a navigator to ride thereon, the floor being provided in an aft or rear portion of a deck constituting the upper portion of the craft body. Upwardly projecting fins are respectively formed on both sides of the floor. Further, a forward-slanting wall member is provided on a portion of the deck forwardly of each of the fins. An operating member used to control the engine of the craft is installed on the forward-slanting wall member.

1 Claim, 2 Drawing Figures

OPERATING MEMBER INSTALLATION FOR A SMALL-SIZED MARINE CRAFT

BACKGROUND OF THE INVENTION

1. Field of the Invention

The present invention relates to a small-sized marine craft which is improved in terms of the manner in which operating members used to control the engine of the craft are installed.

2. Description of the Prior Art

One kind of small-sized marine craft skims over the surface of the water with the navigator or occupant of the craft in either a standing or sitting position. A typical small-sized marine craft of the type described above has conventionally been designed such that the body of the craft is composed of a hull which constitutes the lower part of the body and a deck which constitutes the upper part thereof. The deck has a floor formed in an aft or rear portion thereof. The floor is designed such as to allow the navigator to ride thereon. Further, upwardly projecting fins are respectively formed on both sides of the floor. Such small-sized marine craft are normally equipped with operating members used to control the engine of the craft, such as a fuel cock and a choke knob. These members in the conventional small-sized marine craft have been installed on a front wall which upwardly projects from the front end of the floor as high as the upper ends of the fins (see FIG. 2 in the specification of Japanese Patent Laid-Open No. 58587/1974).

The operating members being installed at such a low position disadvantageously makes it difficult for the navigator to actuate them or to ascertain their state when being actuated during the running of the craft, particularly if he is in a standing position, since, in such a case, the operating members may be located at a position considerably lower for the navigator than in the case where the navigator is in a sitting position. Further, the operating members installed at the above-described position may be undesirably knocked by a foot or other parts of the navigator's body. Furthermore, since, in this type of small-sized marine craft, the water surface is in close proximity to the level of the deck, when the operating members are located lower than the upper ends of the fins on the deck as described above, they may easily be covered with water, which fact may lead to problems.

SUMMARY OF THE INVENTION

In view of the above-described disadvantages of the prior art, it is a primary object of the present invention to provide a small-sized marine craft which has improved operability and reliably allows the navigator to ascertain the state of the operating members when they are actuated and in which the operating members are prevented from being knocked by a foot or other parts of the navigator's body or from being covered with water which would lead to problems.

To this end, according to the present invention, a forward-slanting wall member is provided on a portion of the deck forwardly of each of the fins, and an operating member used for controlling the engine is installed on the forward-slanting wall member.

The above and other objects, features and advantages of the present invention will become clear from the following description of the preferred embodiment thereof, taken in conjunction with the accompanying drawings.

DESCRIPTION OF THE PREFERRED EMBODIMENT

One embodiment of the present invention will be described hereinunder with reference to the accompanying drawings.

Figure 1:
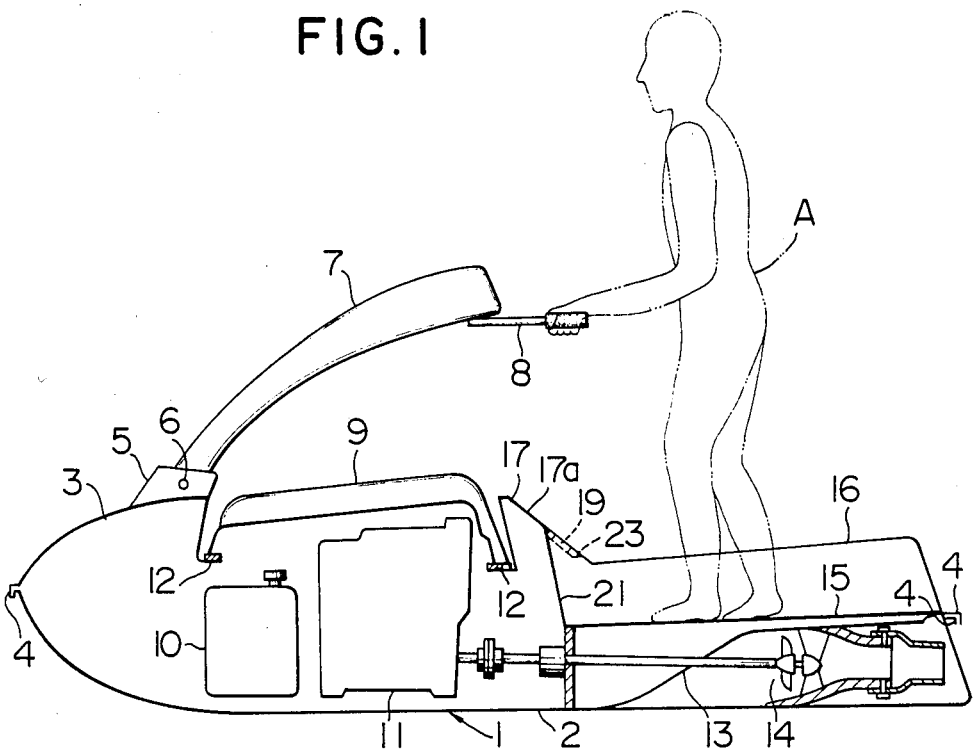
FIG. 1 is a vertically-sectioned side elevational view of a small-sized marine craft in accordance with one embodiment of the present invention.

Referring first to FIG. 1, there is shown one example of a small-sized marine craft which can freely skim over the water surface and is controlled by a navigator A in a standing position. In FIG. 1, a craft body 1 is composed of a hull 2 constituting the lower portion of the body 1 and a deck 3 constituting the upper part thereof, which are bonded together through flanges 4 formed at the respective peripheral edges of the hull 2 and the deck 3. A handle pole bracket 5 is secured to a fore portion of the deck 3. A handle pole 7 is mounted on the bracket 5 through a mounting shaft 6 such as to be pivotal vertically. A handle lever 8 is secured to the handle pole 7. Thus, the navigator A controls the craft by actuating the handle lever 8. An engine cover 9 covers beneath it a fuel tank 10 and an engine 11 which are installed inside the body 1. The engine cover 9 is detachably secured to the deck 3 through a gasket 12 provided at the peripheral edge of the engine cover 9.

Figure 2:
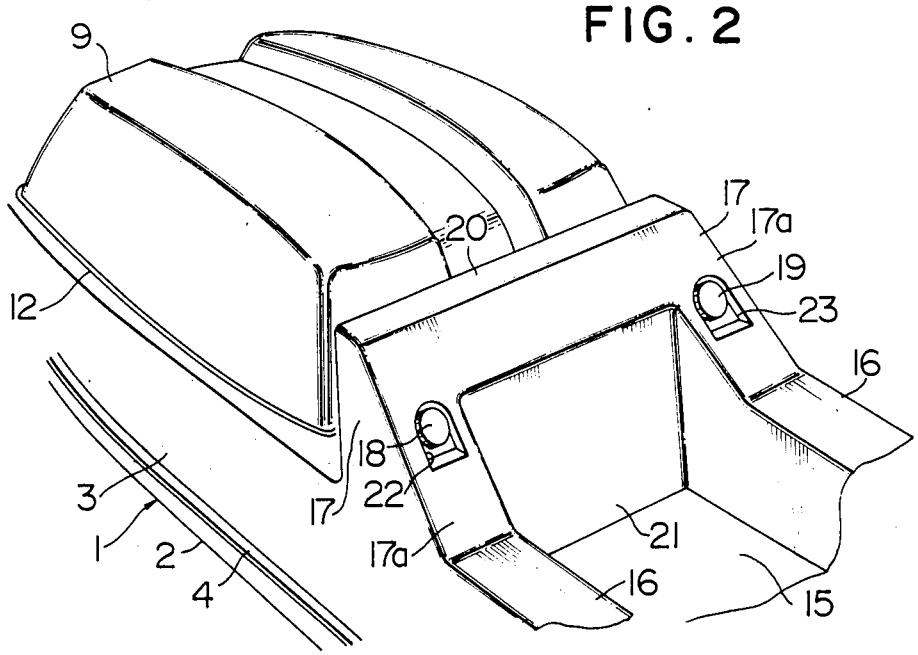
FIG. 2 is a perspective view of the marine craft shown in FIG. 1 as viewed from the rear side thereof.

A duct 13 is provided at the lower side of an aft or rear portion of the craft body 1. A water-jet propeller 14 is mounted in the duct 13. The water-jet propeller 14 is driven by the engine 11, whereby a propulsive force is obtained. A floor 15 is provided in an aft portion of the deck 3. The floor 15 is designed such as to allow the navigator A to ride comfortably thereon. On both sides of the floor 15, upwardly projecting fins 16 are respectively formed, as shown in FIG. 2. A front wall 21 is provided at the front end of the floor 15 such as to rise substatially vertically. On this front wall 21, operating members used to control the engine 11 have heretofore been installed.

According to this embodiment, a side riser 17 having a substantially triangular shape as viewed from the side of the craft is integrally formed with an upper portion of the deck 3 forwardly of each fin 16. Each riser 17 is formed on its aft or rear side with a slanting surface 17*a* which slants toward the fore end of the craft. A fuel cock 18 for controlling the engine is installed in a recess 22 formed in the port-side slanting surface 17*a*, while a choke knob 19 is installed in a recess 23 formed in the starboard-side slanting surface 17*a*. The fuel cock 18 is an operating member used to change over from one to the other fuel passages (not shown) which lead from the fuel tank 10 to the engine 11 shown in FIG. 1. When the fuel cock 18 is turned to an ON position (not shown), a fuel passage for normal use is opened; when the fuel cock 18 is turned to an RES position (not shown), a spare fuel passage employed to use the remaining fuel in the fuel tank 10 is opened. The choke knob 19 is an operating member used to open and close a choke valve (not shown) of the engine 11. Turning the choke knob 19 clockwise causes the choke valve to be opened.

It is to be noted that the poriton connecting together both the side risers 17 is integrally formed with the side risers 17 such as to rise in the manner shown in FIG. 2. Although the connecting portion constitutes a central riser 20 in this embodiment, it is not always necessary to form the connecting portion into a rising structure. Further, the slanting surfaces 17*a* may include those which have curved surfaces.

According to the above-described arrangement, the operating members used to control the engine 11, such as the fuel cock 18 and the choke knob 19, are respectively installed on the forward-slanting surfaces 17*a* of the side risers 17 which rise from the respective front ends of the fins 16. It is, therefore, extramely easy for the nevigator A to see and gain access to these operating members. Thus, it is possible not only to easily observe and ascertain the state of each operating member before it is actuated but also to allow the navigator A to actuate each operating member easily even while navigating the craft. Further, unlike the conventional arrangement in which the operating members are installed on the front wall 21 at the front end of the floor 15, the arrangement in accordance with this embodiment is such that they are respectively located at port- and starboard-side positions obliquely upward of the front wall 21. Accordingly, there is no possibility that the operating members may be undesirably knocked by a foot or other parts of the navigator's body no matter what posture the navigator A may assume. Furthermore, since the installation position of the operating members is at an adequate height above the water surface, whether the craft is at rest or running, these operating members are protected from the risk of being covered with water which would lead to trouble.

What is claimed is:

1. An installation for an operating member for the engine of a small-sized marine craft comprising:

(a) a body composed of a hull constituting a lower portion of said body and a deck constituting an upper part thereof;

(b) a floor provided in an aft portion of said deck to allow a navigator to ride thereon in a standing position;

(c) fore and aft extending fins included in said deck respectively projecting upwards from both sides of said floor;

(d) an operating member for operating and controlling the engine of said craft; and (e) riser means integrally formed with an upper portion of said deck comprising a pair of slanting surfaces each with a top edge and a base edge, said slanting surfaces each rising upwardly and extending forwardly toward said top edge from each of said fins, each of said slanting surfaces joined to a respective one of said fins along its base edge, and said riser means receiving said operating member to provide an installation for said operating member located so that a navigator in standing position can see and actuate the operating member.

* * * * *